United States Patent [19]

Tam et al.

[11] Patent Number: 4,485,007

[45] Date of Patent: Nov. 27, 1984

[54] PROCESS FOR PURIFYING HYDROCARBONACEOUS OILS

[75] Inventors: Patrick S. Tam; James R. Kittrell, both of Amherst, Mass.

[73] Assignee: Environmental Research and Technology Inc., Concord, Mass.

[21] Appl. No.: 388,792

[22] Filed: Jun. 15, 1982

[51] Int. Cl.[3] ..... C10G 17/02

[52] U.S. Cl. ..... 208/221; 208/236; 208/254 R

[58] Field of Search ..... 208/236, 221, 254 R

[56] References Cited

U.S. PATENT DOCUMENTS

| | | | |
|---|---|---|---|
| 508,479 | 11/1893 | Kayser | 208/280 |
| 542,849 | 7/1895 | Frasch | 208/222 |
| 1,864,541 | 6/1932 | Herrmann et al. | 568/458 |
| 1,933,748 | 11/1933 | Morrell | 208/220 |
| 1,935,207 | 11/1933 | Harder et al. | 208/276 |
| 2,009,898 | 7/1935 | Morrell | 208/289 |
| 2,114,852 | 4/1938 | McKittrick | 208/205 R |
| 2,263,176 | 11/1941 | Lazar et al. | 208/254 R |
| 2,311,342 | 2/1943 | Kerns | 208/236 |
| 2,487,577 | 11/1949 | Stanley | 208/236 |
| 2,662,843 | 12/1953 | Castner et al. | 208/254 R |
| 2,702,824 | 2/1955 | Wetterham et al. | 568/27 |
| 2,825,744 | 3/1958 | Smeasluna | 568/27 |
| 3,105,812 | 10/1963 | Fian et al. | 208/254 R |
| 3,163,593 | 12/1964 | Webster et al. | 208/240 |
| 3,164,546 | 1/1965 | Millikan et al. | 208/236 |
| 3,244,618 | 4/1966 | Dimond et al. | 208/236 |
| 3,267,027 | 8/1966 | Fierce et al. | 208/236 |
| 3,341,448 | 9/1967 | Ford et al. | 208/211 |
| 3,804,749 | 4/1974 | Chelet et al. | 208/241 |
| 3,847,800 | 11/1974 | Guth et al. | 208/236 |
| 3,919,402 | 11/1975 | Guth et al. | 423/522 |
| 4,113,607 | 9/1978 | Miller | 208/254 R |
| 4,272,361 | 6/1981 | Compten | 208/254 R |

*Primary Examiner*—Delbert E. Gantz
*Assistant Examiner*—Cynthia A. Prezlock
*Attorney, Agent, or Firm*—Sughrue, Mion, Zinn, Macpeak and Seas

[57] ABSTRACT

A process for purifying hydrocarbonaceous oils containing heteroatom sulfur and heteroatom nitrogen compound impurities comprising the steps of:

(1) reacting said hydrocarbonaceous oil with an oxidizing gas containing at least one nitrogen oxide with more than one oxygen atom for each nitrogen atom while maintaining
  (a) the molar ratio of the nitrogen oxide to the total of the sulfur heteroatom content and the nitrogen heteroatom content to about 1.5:1 or less,
  (b) the reaction time to about one hour or less,
  (c) the temperature to about 100° C. or less, and
  (d) a conversion of sulfur heteroatom content into gaseous sulfur oxides to about 60% or less on a weight basis;

(2) contacting the oil from step (1) above with
  (i) an extracting solvent comprising at least one amine selected from the group consisting of ethylene diamine, monoethanolamine, diethanolamine and mixtures thereof, or a water mixture thereof containing about 50% by weight or less water, and
  (ii) extracting solvent comprising formic acid or a water mixture thereof containing about 50% by weight or less water,
  with the contacting with (i) and (ii) being sequential and in any order; and (3) separating said oil from step (2) above from the extracting solvents;

to recover purified hydrocarbonaceous oil.

17 Claims, 2 Drawing Figures

PROCESS FOR PURIFYING HYDROCARBONACEOUS OILS

FIELD OF THE INVENTION

This invention relates to a process for purifying hydrocarbonaceous oils. More particularly, this invention relates to a process for purifying hydrocarbonaceous oils wherein compounds containing heteroatomic sulfur and compounds containing heteroatomic nitrogen as impurities are removed from the oil. In particular, this invention relates to a process for purifying hydrocarbonaceous oils containing such impurities comprising oxidizing the hydrocarbonaceous oils under conditions enhancing removal by solvents in solvent extraction, solvent extracting the oxidized oil using selected solvents to remove the heteroatom sulfur compound impurities and to remove the heteroatom nitrogen compound impurities followed by separating the oil from the solvents employed for extraction.

BACKGROUND OF THE INVENTION

Prior to the development of the petroleum industry in the first part of the latter half of the 1800's, coal and oil shale had been used as primary sources of energy. However, with the discovery of sources of crude oil and the development of the petroleum industry, the use of coal and oil shale as a source of energy markedly declined.

However, in the mid-1970's as a result of political and economic factors increasing the world oil price markedly and with the recognition that at some time in the future liquid petroleum reserves would be exhausted, the energy industry turned to alternative sources of fossil fuel. Activities in research and development of shale oil and coal thereby increased substantially. This research and development activity has predominantly been directed toward producing readily available supplies of energy from not oil shale and coal but also to recover oil locked up in tar sands such as those in the well-known Athabasca tar sand deposits in Canada.

The world supply of oil shale, coal and tar sands is markedly larger than presently known world reserves of liquid petroleum. Procedures to unlock the components of oil shale, coal and tar sands to substitute for present petroleum products produced from crude oil have been actively investigated by many large oil companies. Generally, the approach has been to resort to retorting processes to recover the components locked up in oil shale, notably kerogen, coal and tar sands.

Unfortunately, the level of oxygen-, nitrogen- and sulfur-containing components in oil recovered from oil shale, coal and tar sands is typically much higher than that experienced with petroleum. Industrial concerns exist as to the presence of sulfur and nitrogen impurities in oil derived from such sources because their presence can lead to corrosion of processing equipment, and poisoning of catalysts used in cracking or reforming of the oil in producing various desirable consumer products therefrom. This has meant that in addition to research and development on efficient and economically viable methods of not only recovering the oil from oil shale, coal and tar sand sources, methods to remove or at least reduce the level of these impurities are essential.

Further, with increasing environmental concerns and with more stringent federal, state and local regulations on emission of noxious gases into the environment, for this reason along research and development on methods of reduction of such impurities are essential.

The problem of removal of particularly sulfur and nitrogen compound impurities from oil sources such as shale oil has been recognized in the art. The most generally used present approach for desulfurizing petroleum is catalytic hydro-desulfurization at high temperature and high pressure. In this process, hydrogen is reacted with the sulfur present as an impurity to form hydrogen sulfide and the hydrogen also reacts with the nitrogen present in the impurities to form ammonia. The hydrogen sulfide can be scrubbed and ammonia is removed generally with water washing. Unfortunately, the hydro-desulfurization process for purification involves a high operating cost because of the high temperature and high pressure conditions of operation, the necessity for use of safety precautions when hydrogen is employed, the consumption of hydrogen which is expensive, undesirable hydrogenation of unsaturated hydrocarbons present in the oil and catalyst usage, to name a few of the problems recognized with catalytic hydro-desulfurization of oil obtained from sources such as oil shale, coal and tar sands.

Recently, with the change in economic conditions resulting in a marked decrease in world oil prices and a surplus of oil available from conventional petroleum sources, research and development toward production of alternative energy sources from oil shale, coal and tar sands have become more difficult to justify economically. However, it must be recognized that employing oil shale, coal and tar sands as energy sources will ultimately become a necessity to supply the world's energy needs. Thus, it is particularly important to develop methods of removal of impurities, particularly sulfur- and nitrogen-containing organic compounds from oil produced from oil shale, coal and tar sands.

The invention described and claimed herein is directed to a process for sulfur- and nitrogen-containing organic compound impurity removal from hydrocabonaceous oils utilizing an oxidation/extraction/separation approach to impurity removal in opposition to the currently used catalytic hydro-desulfurization approach as conventionally practiced.

As to the oxidation of petroleum stocks to remove sulfur-containing compounds, oxidation using nitric acids was investigated as early as 1893 (as disclosed in U.S. Pat. No. 508,479) and a process is described in U.S. Pat. No. 542,849, issued in 1895, which involves the oxidation of petroleum stocks using nitrous acid fumes. Further, U.S. Pat. No. 1,864,541, issued in 1925, discloses the oxidation of organic compounds by nitrogen oxides at 400° to 500° C. with contact times on the order of seconds, the oxidation being either homogeneous or catalytic using copper and silver catalysts. U.S. Pat. No. 1,933,748 describes the utilization of nitrogen oxides to remove sulfur compounds from cracked petroleum stocks at 150° to 350° F. followed by the use of sulfuric acid for extraction and U.S. Pat. No. 1,935,207 describes a similar process with disclosure of improved results where the oxidation is carried out using nitrogen oxides in the presence of sulfuric acid at a temperature below 30° C. U.S. Pat. No. 2,009,898 describes the treatment of cracked gasoline vapors with nitrogen oxides without significant olefin oxidation, followed by clay-treatment of the product to achieve a reduction in sulfur content. U.S. Pat. No. 2,825,744 discloses a similar process operated in the vapor phase at temperatures less than 200° C. to produce low molecular weight sulfoxides.

Techniques, including an extraction step, for removal of sulfur impurities from oil are also known. For example, U.S. Pat. No. 2,114,852 discloses a process comprising heating high boiling hydrocarbon oils or shale containing objectionable sulfur compounds as an impurity to obtain hydrocarbon fractions, extracting the product obtained with polar solvents to remove high boiling sulfur compounds in the presence of unsaturated hydrocarbons, followed by oxidizing the extract. U.S. Pat. No. 3,163,593 describes a process using a number of different types of oxidants, including nitrogen dioxides, to treat vacuum residues, residues from cracking processes, oil from tar sands and oil shale followed by thermal decomposition at 350° to 400° C. to produce volatile sulfur compounds and low sulfur oil. The disclosure in this patent is that an alkaline material such as dolomite or lime can be used to accelerate the process.

The use of air as an oxidizing agent for thermally decomposed residues, along with Group 5A and Group 8 metal catalysts, as an alternative to nitrogen oxides, followed by hydro-desulfurization is disclosed in U.S. Pat. No. 3,341,448. A disclosed advantage of this procedure is higher degrees of desulfurization at comparable conditions than can be achieved with hydro-treating alone.

Oxidation/extraction processes of hydrocarbonaceous oils to produce sulfoxides and sulfones are also known in the art as disclosed in U.S. Pat. No. 2,825,744, British Pat. No. 442,524, U.S. Pat. No. 2,702,824, and U.S. Pat. No. 2,925,442.

The art also recognizes that nitrogen removal from oil can be also achieved by oxidation. For example, U.S. Pat. No. 3,105,812 discloses the treatment of a variety of petroleum stocks or shale oil with air or ozone utilizing mixed phosphorus and vanadium oxide catalysts. The disclosure is that preoxidation appears to remove those nitrogen-containing compounds which are more difficult to remove by hydrogenation and as a result, any subsequent hydrodenitrification step can be conducted under less severe conditions for complete nitrogen removal than if a hydrodenitrification step were used alone.

Further, U.S. Pat. Nos. 3,847,800 and 3,919,402 describe the use of nitrogen oxides followed by extraction by methanol to remove both sulfur and nitrogen compounds from petroleum stocks.

It is known in the art that liquid extraction can be employed to separate oxidized sulfur compounds and nitrogen compounds from oil. A hydrolysis reaction with a dilute base to separate the inorganic compounds from a hydrocarbon is described in U.S. Pat. No. 3,847,800. Separations in the organic chemistry field to remove sulfur and nitrogen impurities utilize physical interactions between sulfur and nitrogen compounds as a solute in a solution and the solvents employed for extraction, with an advantageous physical difference being polarity. Since oxidized organic compounds are generally polar in nature, based on these physical principles, this might suggest a successful solvent for extraction, for example, of impurities from a hydrocarbonaceous oil would be a polar solvent. Further knowledge of solvent extraction procedures would indicate that a solvent for use in extraction of impurities from a hydrocarbonaceous oil desirably would be of immiscibile in the oil, would not form an emulsion with the oil, would have a different density from the oil and would have a boiling point difference to facilitate recovery of solvent after the extraction. From a commercial standpoint, advantageously the solvent should also be low in cost and should not alter, in the case of hydrocarbonaceous oils, the ability of such to be subsequently used as a fuel.

As described above, methanol is disclosed in U.S. Pat. Nos. 3,847,800 and 3,919,402 as a solvent to remove both sulfur and nitrogen compounds after oxidation of petroleum stocks using nitrogen oxides. U.S. Pat. No. 2,114,852 discloses a preference for solvents whose boiling points are no more than 80° C. below the boiling range of the initial hydrocarbonaceous oil mixture to facilitate ease of fractionation. I. N. Diyarov, *Khim. Tekhnol. Topl. Masel,* (5), p. 14–16 (1978) discloses treatment of diesel fuel with ethylene chlorohydrin mixed with water and Yu. E. Nikitin, *Neftekhimiya,* 16, (6), p. 917–920 (1976) describes a comparison of extraction of sulfoxides from diesel fuel using citric and tartaric acids with citric acid being found to be five times more efficient than tartaric acid in the extraction of sulfoxides. An aqueous solution of quaternary ammonium compounds (as disclosed in Japanese Patent Application (OPI) No. 74-30,401) and an aqueous alkali and organic solvents (as disclosed in U.S. Pat. No. 3,164,546) are also described in the art as suitable for treating diesel fuel oil. Further, U.S. Pat. No. 4,113,607 describes the use of ferric chloride and furfural as an effective solvent in reducing the nitrogen content in hydrogenated oils and U.S. Pat. No. 3,804,749 discloses the utilization of a complex of boron trifluoride in a petroleum immiscible solvent to remove sulfur in oil.

Knowledge of hydrocarbonaceous oils produced from sources such as oil shale, coal and tar sands indicates that a major component of the sulfur compounds in oil from these sources is thiophenic sulfur. As a result, processing to remove impurities from hydrocarbonaceous oils, particularly where sulfur-containing impurities are present, should involve a recognition that thiophenic sulfur-containing compounds must be removed and, based on the art, this would appear to be difficult without sufficient oxidation of the crude hydrocarbonaceous oil.

Approaches toward oxidation of sulfur impurities such as thiophenic compounds to sulfoxides and sulfones and to correspondingly achieve an oxidized form of the organic nitrogen compound impurities present to convert such impurities into forms more easily extractable without loss of the desirable hydrocarbonaceous oil or alteration thereof has, in the past, met with some limited success.

Unfortunately, the prior art approaches toward oxidation to remove a portion of the original sulfur content as gaseous sulfur oxides and to convert a portion of the original sulfur content into sulfoxides and/or sulfones followed by extraction with appropriate solvents to achieve a desired low sulfur raffinate have not been completely successful.

The prior art methods described above basically have the disadvantages that (a) they are sufficiently nonselective that extremely severe oxidizing conditions are required to effect sulfur removal, resulting in undesirable and substantial increases in the nitrogen content of the oil; (b) they use a solvent which is suitable only for specific selected oils, they result in poor extraction yields or they do not result in sufficient phase separation that solvent extraction is possible; (c) they require expensive or complicated processing equipment; or (d) they involve combinations of the disadvantages enumerated above.

Thus, present technology for impuritiy removal involving oxidation and subsequent extraction of hydrocarbonaceous oils needs to be greatly improved. Similarly, direct extraction of hydrocarbonaceous oils with selected solvents to remove sulfur and nitrogen impurities to produce a raffinate which is low in sulfur and nitrogen content results in uneconomically low yields of the desired raffinate, reductions in the sulfur and nitrogen content of the hydrocarbonaceous oil which are uneconomic or combinations of these. The prior approaches involving high temperature, high pressure hydro-desulfurization to reduce the sulfur and nitrogen content of hydrocarbonaceous oils involve a number of major disadvantages. As indicated previously, the high temperature, high pressure requirements of the process makes the process quite expensive. The hydrogen required in the process is expensive and requires water for its production. Unfortunately, in those areas where major deposits of oil shale exist, water to produce the hydrogen may well be in short supply. Investigations of the process have resulted in finding that the process is nonselective in that although sulfur and nitrogen compounds are removed, desirable olefinic or aromatic compounds are also destroyed. Processing of the products produced such as hydrogen sulfide, which is highly toxic, and ammonia also contributes to the expense of the process and in view of the catalytic nature of the process, with the catalyst being poisoned by materials contained in the hydrocarbonaceous oil, this even further contributes to the expense of the process. All of these factors result in the process not being economically desivable.

SUMMARY OF THE INVENTION

An object of this invention is to provide a process whereby sulfur- and nitrogen-compound impurities present in hydrocarbonaceous oils can be removed.

Another object of this invention is to provide a process for purifying hydrocarbonaceous oils wherein heteroatom sulfur and heteroatom nitrogen compound impurities can be removed without destroying or reducing the content of other desirable components, such as aromatics and olefinics, of the oil.

A further object of this invention is to provide a process for removing sulfur- and nitrogen-compound impurities from hydrocarbonaceous oils wherein a marked reduction of the sulfur- and nitrogen-compound impurities over that present originally in the oil can be achieved and at the same time a high yield of hydrocarbonaceous oil can be obtained from the process.

An even further object of this invention is to provide a process for purifying hydrocarbonaceous oils wherein impurities can be removed under mild conditions such that the necessity for expensive processing and control equipment, required in prior art approaches, is eliminated.

An additional object of this invention is to provide a process for purifying hydrocarbonaceous oils to remove heteroatom sulfur- and nitrogen-compound impurities therefrom wherein processing of the impurities, which would cause damage to the environment if released directly, can be facilitated.

Also, an additional object of this invention is to provide a process for purification of hydrocarbonaceous oils involving sulfur- and nitrogen-compound impurity removal which is simpler and less expensive than prior approaches to hydrocarbonaceous oil purification.

Accordingly, one embodiment of this invention provides a process for purifying hydrocarbonaceous oils containing heteroatom sulfur and heteroatom nitrogen compound impurities, this embodiment comprising the steps of:

(1) reacting the hydrocarbonaceous oil with an oxidizing gas containing at least one nitrogen oxide with more than one oxygen atom for each nitrogen atom, while maintaining:

(a) the molar ratio of the nitrogen oxide to the total of the sulfur heteroatom content and the nitrogen heteroatom content to about 1.5:1 or less, (b) the reaction time to about one hour or less, (c) the temperature to about 100° C. or less, and (d) the conversion of sulfur heteroatom content into gaseous sulfur oxides to about 60% or less on a weight basis;

(2) contacting the oil from step (1) above with (i) an extracting solvent comprising at least one amine selected from the group consisting of ethylene diamine, monoethanolamine, diethanolamine, and mixtures thereof, or a water mixture thereof containing about 50% by weight or less water, and (ii) an extracting solvent comprising formic acid or a water mixture thereof containing about 50% by weight or less water, the contacting with the extracting solvent (i) and the extracting solvent (ii) being sequential and in any order; and (3) separating the oil from step (2) above from the extracting solvents to recover purified hydrocarbonaceous oil.

Where the nature of the hydrocarbonaceous oil containing heteroatom sulfur and heteroatom nitrogen compound impurities is such that either the heteroatom sulfur compound impurity or the heteroatom nitrogen compound impurity is sufficiently low that problems in use without reduction of that impurity level would not give rise to substantial problems in use of the oil, another embodiment of this invention provides a process for purifying such hydrocarbonaceous oils comprising the steps of:

(1) reacting the hydrocarbonaceous oil with an oxidizing gas containing at least one nitrogen oxide with more than one oxygen atom for each nitrogen atom, while maintaining:

(a) the molar ratio of the nitrogen oxide to the total of the sulfur heteroatom content and the nitrogen heteroatom content to about 1.5:1 or less, (b) the reaction time to about one hour or less, (c) the temperature to about 100° C. or less, and (d) the conversion of sulfur heteroatom content into gaseous sulfur oxides to about 60% or less on a weight basis;

(2) contacting the oil from step (1) above with an extracting solvent comprising:

(i) at least one amine selected from the group consisting of ethylene diamine, monoethanolamine, diethanolamine, and mixtures thereof, or a water mixture thereof containing about 50% by weight or less water where removal of heteroatom sulfur compound impurities is desired, or (ii) an extracting solvent comprising formic acid or a water mixture thereof containing about 50% or less water, where removal of heteroatom nitrogen compound impurities is desired; and (3) separating the oil from step (2) above from the extracting solvent to recover purified hydrocarbonaceous oil.

A preferred embodiment of the process of this invention involves a process for purifying hydrocarbonaceous oils containing heteroatom sulfur and heteroatom nitrogen compound impurities comprising the steps of:

(1) reacting the hydrocarbonaceous oil with an oxidizing gas containing at least one nitrogen oxide with more than one oxygen atom for each nitrogen atom, while maintaining:
   (a) the molar ratio of the nitrogen oxide to the total of the sulfur heteroatom content and the nitrogen heteroatom content to about 1:1 or less,
   (b) the reaction time to about 30 minutes or less,
   (c) the temperature to about 60° C. or less, and
   (d) the conversion of sulfur heteroatom content into gaseous sulfur oxides to about 60% or less on a weight basis;

(2) contacting the oil from step (1) above with
   (i) an extracting solvent comprising at least one amine selected from the group consisting of ethylene diamine, monoethanolamine, diethanolamine, and mixtures thereof, or a water mixture thereof containing about 50% by weight or less water, and
   (ii) an extracting solvent comprising formic acid or a water mixture thereof containing about 50% by weight or less water, the contacting with the extracting solvent (i) and the extracting solvent (ii) being sequential and in any order; and (3) separating the oil from step (2) above from the extracting solvents to recover purified oil.

A particularly preferred embodiment of the process of this invention comprises utilizing monoethanolamine as the extracting solvent (i) and an even further particularly preferred embodiment of this invention involves contacting the oil in step (2) with the extracting solvent (i) followed by the extracting solvent (ii) in order.

BRIEF DESCRIPTION OF THE ACCOMPANYING DRAWINGS

DETAILED DESCRIPTION OF THE INVENTION

As indicated above, this invention provides a process for purifying hydrocarbonaceous oils containing heteroatom sulfur and heteroatom nitrogen compounds as impurities in the hydrocarbonaceous oil. The process of this invention is applicable to the purification of hydrocarbonaceous oil which can be derived from any source, for example, conversion of oil shale, coal and tar sands into a crude hydrocarbonaceous material, hereinafter hydrocarbonaceous oil. Further, the hydrocarbonaceous oil can be a conventional petroleum crude oil or crude oil fraction containing sulfur and/or nitrogen compound impurities. The terms "oil" and "hydrocarbonaceous oil" are used herein interchangeably and are basically employed in their generic sense to describe any hydrocarbon which is considered to be liquid or substantially liquid at room temperature. These terms are intended to encompass not only those materials which are pourable at room temperature but those materials which may be considered liquid yet having a viscosity sufficiently high to render them basically nonpourable. Various conventional fractions and boiling point cuts may be present therein.

The process of this invention is basically not limited in terms of the source of the hydrocarbonaceous oil but is applicable to any hydrocarbonaceous oil such as those obtained by thermally treating oil shale, coal and tar sands giving rise to a crude and subsequently subjectable to processing, to produce various components such as gasoline, kerosene, diesel and fuel oils as well as asphalts. The process of this invention is applicable to any such hydrocarbonaceous oil or fraction thereof which contains sulfur and nitrogen compound impurities where removal of these impurities from the oil is desired.

For ease of discussion in the following description of this invention, the embodiments thereof will be described by reference to the use of shale oil as a hydrocarbonaceous oil. It should be emphasized, however, that the description as to use of shale oil here is merely for the purposes of exemplification and ease of description and the process of the present invention should in no way be construed as being limited to shale oil or materials derived therefrom.

Figure 1:
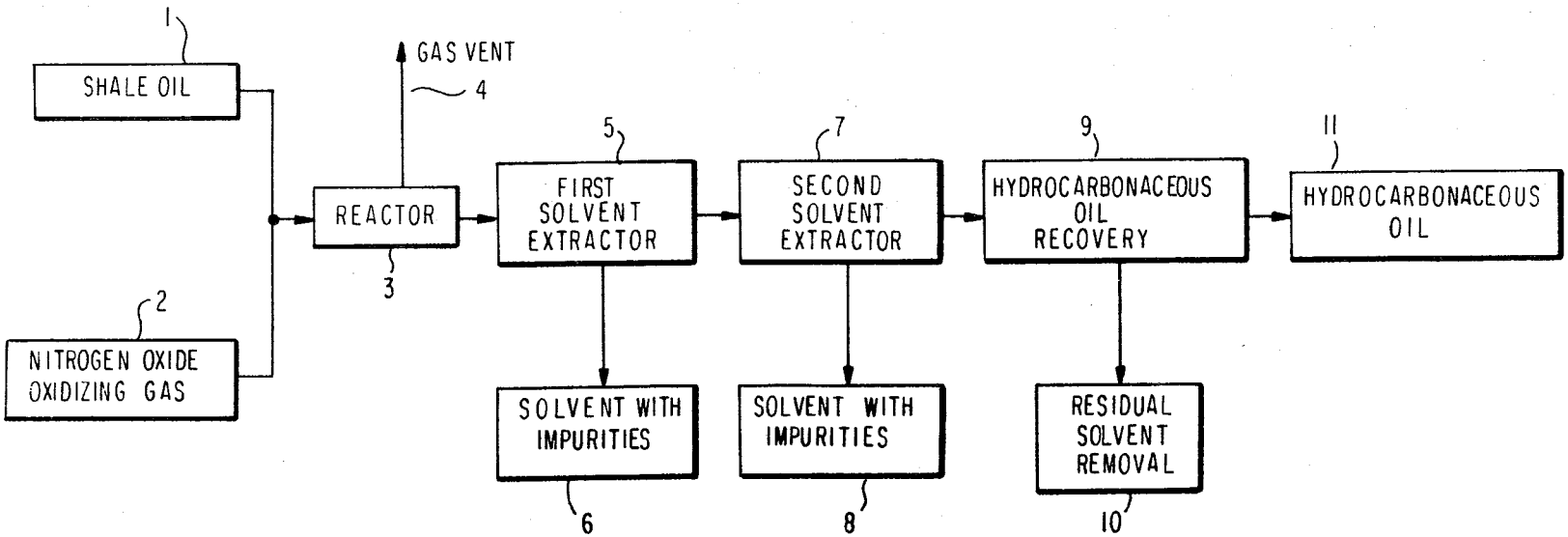
FIG. 1 is a schematic flow diagram of one embodiment of the process of this invention.

FIG. 1 describes schematically an embodiment of the process of this invention comprising mixing crude shale oil 1 and the nitrogen oxide oxidizing gas 2 and passing the mixture into a reactor 3. After reaction in the reactor, the oxidized shale oil is passed into a first solvent extractor 5 where such is contacted with a first extracting solvent (either extracting solvent (i) or extracting solvent (ii)) and after solvent/ oxidized oil separation to remove solvent with impurities 6, the oxidized oil is passed into a second solvent extractor 7 and mixed with the other of the extracting solvents (either extracting solvent (i) or extracting solvent (ii)). After separation of the oil from the second extracting solvent to remove solvent with impurities 8, the hydrocarbonaceous oil with residual solvent is subjected to recovery at 9 to remove residual solvents 10 and obtain purified hydrocarbonaceous oil 11.

In the first step of the process of this invention, a hydrocarbonaceous oil such as shale oil is reacted and oxidized by contacting the oil with an oxidizing gas. This oxidizing gas is one which contains at least one nitrogen oxide with more than one oxygen atom for each nitrogen atom. The oxidizing gas used can be a gas containing only such a nitrogen oxide or can be one which contains mixtures of such nitrogen oxides. Further, the oxidizing gas can be one which contains other components such as oxygen, nitrogen, lower nitrogen oxides, i.e., nitrogen oxides containing only one oxygen atom or less than one oxygen atom per nitrogen atom in the oxide. For efficiency, preferably, the oxidizing gas will be one which contains only nitrogen oxides with more than one oxygen atom for each nitrogen atom but mixtures with other gases such as oxygen, nitrogen, as well as inert gases such as helium and helium or with air can be employed if desired. Suitably, the oxidizing gas will contain at least 0.5% by volume of at least one nitrogen oxide with more than one oxygen atom for each nitrogen atom. Nitrogen dioxide or its dimer $N_2O_4$ can be advantageously employed, alone or in admixture with air.

Typically, the process of this invention can be employed on a hydrocarbonaceous oil derived from oil shale. Oil shale contains kerogen as an organic component thereof and shale oil typically is produced from kerogen by retorting at temperatures in the range of 450° to 500° C. As indicated above, nitrogen, sulfur and oxygen compounds are present in shale oil produced from kerogen in larger amounts than typically are present in crude oil derived from liquid petroleum sources. Typically, oxygen compounds are found in shale oil as carboxylic acids and phenols, sulfur as a heteroatom is present as thiols, disulfides, sulfides and thiophenes and nitrogen is typically present as substituted pyridines and pyrroles. A typical analysis of raw oil shale and of crude shale oil produced therefrom, as published by the Laramie Energy Technology Center of the Department of Energy, is set forth in Tables 1 and 2 below.

TABLE 1

| | |
|---|---|
| Fisher assay, gal/ton | 25.70 |
| Oil content, % | 9.80 |
| Water content, % | 1.90 |
| Hydrogen, % | 1.71 |
| Mineral carbon, % | 4.76 |
| Organic carbon, % | 11.15 |
| Carbon dioxide, % | 17.44 |
| Mineral carbonate, % | 23.79 |
| Total carbon, % | 15.91 |
| Ash, % | 67.62 |
| Nitrogen, % | 0.48 |
| Sulfur, % | 0.60 |
| Heating value, Btu/lb | 2256.00 |

TABLE 2

| | |
|---|---|
| Naphtha, vol % | 8.90 |
| Light distillate, vol % | 21.00 |
| Heavy distillate, vol % | 40.80 |
| Residuum | 24.30 |
| Specific gravity, 60° F./60° F. | 0.929 |
| Gravity, API | 20.80 |
| Pour point, °F. | 55.00 |
| Viscosity, SUS @ 100° F. | 114.60 |
| Hydrogen, % | 11.39 |
| Nitrogen, % | 1.75 |
| Carbon, % | 83.19 |
| Sulfur, % | 2.85 |
| Heating value, Btu/lb | 18,372.00 |

As can be seen from an examination of the analysis presented above in Table 2, a crude shale oil typically has a high nitrogen content and a high sulfur content and the process of this invention can be quite advantageous for purifying such so that the levels of sulfur and nitrogen compound impurities therein can be thereby reduced.

In the first step of the process of this invention a hydrocarbonaceous oil such as shale oil is reacted with an oxidizing gas such as at least one nitrogen oxide with more than one oxygen atom for each nitrogen atom or an oxidizing gas containing at least one nitrogen oxide with more than one oxygen atom for each nitrogen atom. The contacting of the hydrocarbonaceous oil with the oxidizing gas can be using any means conventional in the art for contacting a gaseous reactant with a liquid reactant. Suitable examples of such means for contacting a gaseous reactant with a liquid reactant include dispersing a gas as bubbles in a liquid, trickling a liquid over an inert solid bed with gas passing also over the bed concurrently or countercurrently to the liquid flow, the latter type flow being preferred.

It is important in the first step of the process of this invention to control the operating parameters during the reacting of the hydrocarbonaceous oil with the oxidizing gas to ensure oxidation of the sulfur and nitrogen heteroatom compound containing impurities to the extent that extraction efficiency in the second step of the process of this invention is maximized and deleterious effects on the hydrocarbonaceous oil substrate ultimately obtained and recovered after the process for purification of this invention do not arise. These important processing controls as to the reaction of the hydrocarbonaceous oil with the oxidizing gas are described in detail below.

A particularly important parameter to control during the reaction of the hydrocarbonaceous oil with the oxidizing gas in the first step of the process of this invention is to control the molar ratio of (i) the nitrogen oxide in the oxidizing gas to (ii) the total of the sulfur heteroatom content and the nitrogen heteroatom content to about 1.5:1 or less, more preferably about 1:1 or less and most preferably to about 0.5:1 to above about 0.1:1. By controlling the molar ratio of nitrogen oxide in the oxidizing gas to the total of the sulfur heteroatom content and the nitrogen heteroatom content to the range of about 1.5:1 to about 0.1:1, the oil yield ultimately obtained can be maximized with maximum efficiency of reduction in the sulfur and nitrogen content originally present in the crude hydrocarbonaceous oil. This control of the molar ratio of nitrogen oxide to the total of the sulfur heteroatom content and nitrogen heteroatom content can be easily maintained. For example, with a knowledge of the concentration of the nitrogen oxide in the oxidizing gas and from a knowledge of the sulfur heteroatom content and the nitrogen heteroatom content, attained using conventional chemical analysis on the crude hydrocarbonaceous oil, of the hydrocarbonaceous oil as a feed, the feed ratios of the hydrocarbonaceous oil and the oxidizing gas can be adjusted. Conventional means for metering gaseous and liquid reactants can be employed.

Another important parameter controlled during reaction of a hydrocarbonaceous oil such as shale oil with the oxidizing gas in the process of this invention is to control the reaction time, which can be expressed also in terms of reactant contact time, to about one hour or less, more preferably about 30 minutes or less, even more preferably to about 15 minutes or less and most preferably to about five minutes or less. It must be recognized that there is a balance between the minimum contact time and the maximum contact time. The minimum contact time basically which can be used in the process of this invention is that contact time which is necessary in order to achieve oxidation to some extent of the hydrocarbonaceous oil containing the impurities and contact times of less than about five minutes may provide less than optimal oxidation results. Longer contact times, for example, on the order of contact times of 30 to 60 minutes, while resulting in the ability to improve upon sulfur heteroatom compound impurity removal, may result in a reduction in the ability to simultaneously achieve a reduction in the heteroatom nitrogen compound content present in the crude hydrocarbonaceous oil.

Figure 2:
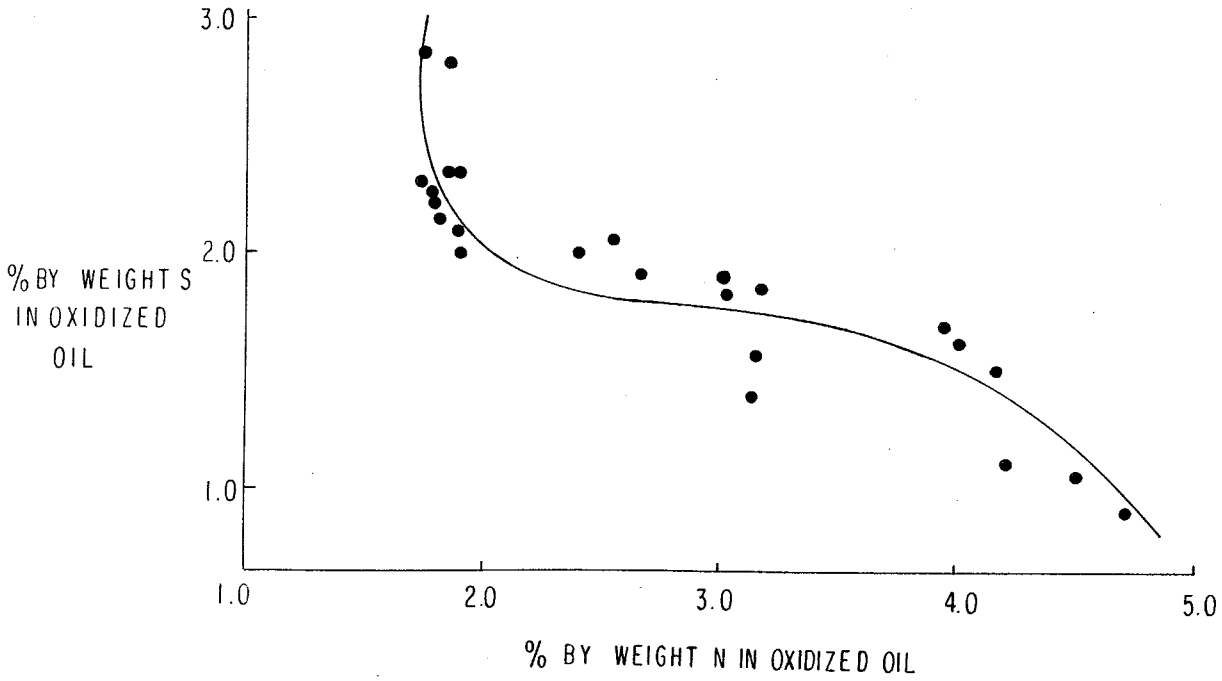
FIG. 2 is a graphical presentation showing the relationship of sulfur and nitrogen levels in a hydrocarbonaceous oil subjected to oxidation in the process of this invention.

FIG. 2 shows the effect on increasing oxidation severity where oxidation of the crude shale oil more severely can result in a reduction in the present heteroatom sulfur content of the purified oil but that this must be balanced with undesirable increase in the percent heteroatom nitrogen content impurities arising as a result of nitration of the hydrocarbonaceous oil substrate.

While not desiring to be bound, the reason for the increase in observed nitrogen compound content over that originally present in the hydrocarbonaceous oil is believed to be that with longer contact times, in view of the use of an oxidizing gas containing at least one nitrogen oxide with more than one oxygen atom for each nitrogen atom that nitration of the hydrocarbonaceous oil substrate can occur resulting in an increase in the heteroatom nitrogen compound impurity content. It has been found, however, that an interrelationship exists between the contact time of the oxidizing gas containing the nitrogen oxide as discussed above and the mole ratio of nitrogen oxide in the oxidizing gas to the total sulfur heteroatom content and the nitrogen heteroatom content of the hydrocarbonaceous oil. As can be seen from the examples given hereinafter to illustrate the present invention, for longer contact times, desirably the mole ratio of nitrogen oxide to the total of the sulfur heteroatom content and the nitrogen heteroatom content should be appropriately reduced. For example, by utilizing low mole ratios of nitrogen oxide to total sulfur heteroatom content and nitrogen heteroatom content, longer contact times can be employed without deleteriously affecting the degree of sulfur content removal, the degree of nitrogen content removal and without undesired nitration of the hydrocarbonaceous oil substrate. Short contact times on the order of about five minutes and lower mole ratios of nitrogen oxide to total sulfur heteroatom content and nitrogen heteroatom content of about 0.5:1 are desirable not only from the standpoint of efficiency of operation but also from the standpoint of economics. Particularly preferably, a contact time of around five minutes in combination with a molar ratio of nitrogen oxide to total sulfur heteroatom content and nitrogen heteroatom content in the crude hydrocarbonaceous oil of about 1:1 or less can be advantageously employed with maximal yield of reduced sulfur content/nitrogen content from hydrocarbonaceous oil.

One skilled in the art can easily determine for a particular crude hydrocarbonaceous oil to be purified what the appropriate mole ratio of nitrogen oxide to total sulfur heteroatom content/nitrogen heteroatom content and appropriate contact time should be. One skilled in the art need only conduct a series of routine oxidations and extractions in accordance with the process of this invention and by varying the contact time and mole ratio of nitrogen oxide to total sulfur heteroatom content/nitrogen heteroatom content and from analysis of the results, one can easily determine the best balance between these reaction parameters of contact time and molar ratio.

Control of the reaction time or contact time of the oxidizing gas can be easily achieved by appropriately controlling reactant feed rate to the reactor to thereby control the reaction or contact time. Conventional chemical engineering principles and techniques can be generally employed to achieve this control and such control is well within the skill of one of ordinary skill in the art.

A further parameter which is controlled in step (1) of the process of this invention is to employ mild temperature conditions and this is a particularly advantageous feature of the process of this invention. Specifically, the temperature at which the reaction of the oxidizing gas with the hydrocarbonaceous oil is conducted is a temperature of about 100° C. or less, more preferably about 60° C. or less and most preferably at about 30° C. or less. The ability to achieve an oxidation of the hydrocarbonaceous oil utilizing the oxidizing gas employed in step (1) of the process of this invention and operation at temperatures of about 100° C. or less provides the ability to oxidize the hydrocarbonaceous oil in an extremely efficient and cost effective manner. Since only temperatures of about 100° C. or less are required, energy requirements to achieve these appropriate reaction temperature conditions are markedly reduced in comparison with high temperature, high pressure hydrodesulfurization conventionally employed in the past as a means for reducing the impurity content in hydrocarbonaceous oils. In fact, a particularly advantageous aspect of this invention is the utilization of an oxidizing gas containing at least one nitrogen oxide with more than one oxygen atom for each nitrogen atom which provides the ability to achieve an oxidation of the hydrocarbonaceous oil thereby permitting a reduction in the nitrogen/sulfur compound impurity content under extremely mild conditions not heretofore generally believed possible. This unique choice of oxidizing gas and reaction temperature thus provides a particularly advantageous aspect of this invention in that within the temperature ranges required for step (1), the energy requirements to achieve such can be considered to be minimal.

An even further parameter controlled in step (1) of the process of this invention is to conduct the reaction of the oxidizing gas containing at least one nitrogen oxide with more than one oxygen atom for each nitrogen atom with the hydrocarbonaceous oil under conditions such that a maximum of 60% of the sulfur heteroatom content is converted into gaseous sulfur oxides. It has been found that a balance exists between sulfur content removal and nitrogen content removal in using the process of this invention. More specifically, oxidization of crude hydrocarbonaceous oil to high extents results in the ability to reduce the sulfur heteroatom content. However, under conditions where more than about 60%, on a weight basis, of the sulfur heteroatom content is converted into gaseous sulfur oxides, the nitrogen heteroatom content impurity level of the oxidized hydrocarbonaceous oil increases. While not desiring to be bound, the reason for this is believed to be in situ nitration of the hydrocarbonaceous oil substrate. Where an in situ nitration occurs, this is detrimental because under these circumstances the nitrogen heteroatom content of the oxidized hydrocarbonaceous oil is increased. This heteroatom nitrogen compound impurity content arises from that originally present in the crude hydrocarbonaceous oil as well as heteroatom nitrogen compound impurities arising as a result of nitration of the hydrocarbonaceous oil substrate. This is illustrated graphically in FIG. 2, described hereinbefore.

As a result, in step (1) of the process of this invention, the reaction of the hydrocarbonaceous oil with the oxidizing gas is conducted under conditions such that about 60% or less on a weight basis of the sulfur heteroatom content of the crude hydrocarbonaceous oil is converted into gaseous sulfur oxides. This step of the process of this invention can be simply monitored by analyzing off-gas vented from the reactor and with knowledge of the heteroatom sulfur compound impurity content of the crude hydrocarbonaceous oil being processed and the content of gaseous sulfur oxides present in the off-gas, parameters of contact time, molar ratio of the nitrogen oxide to total sulfur heteroatom content/nitrogen heteroatom content and temperature can be appropriately adjusted to achieve about 60% or less conversion, on a weight basis, of sulfur heteroatom content into gaseous sulfur oxides.

A hydrocarbonaceous oil, after being subjected to the reaction described above for step (1) of the process of this invention, is then subjected to an extraction step (2) with an appropriate extracting solvent. As will be seen from the examples to be given hereinafter, processing conditions set forth for the oxidation step (1) above are judiciously controlled to maximize the ability of the specific and selected extracting solvents used in the extraction step (2) of the process of this invention to facilitate removal by extraction of the sulfur and nitrogen content present originally in the crude hydrocarbonaceous oil and thereby reduce their levels in the ultimate oil recovered and purified as a result of the process of this invention.

In the extraction step (2) of the process of this invention, one extraction involves contacting the oil obtained from step (1) of the process of this invention with an extracting solvent comprising at least one amine selected from the group consisting of ethylene diamine, monoethanolamine, diethanolamine or mixtures thereof.

Further, in extraction step (2) of the process of this invention, in another extraction, the oil is simply contacted with an extracting solvent comprising formic acid.

These two extraction steps are conducted sequentially on hydrocarbonaceous oil produced from step (1) of the process of this invention. For example, the hydrocarbonaceous oil produced in step (1) can be first contacted with one or more of the amine extracting solvents described above and then with formic acid as an extracting solvent. Alternatively, the hydrocarbonaceous oil processed in accordance with step (1) can be first contacted with formic acid and subsequently with one or more of the amine extracting solvents set forth above. In both of these extracting steps, conventional extraction procedures are employed. Generally, the extracting solvent, whether amine or formic acid, is simply added to and mixed with the hydrocarbonaceous oil processed as in step (1). The length of time for contact of the extracting solvent, whether amine or formic acid, is only that time necessary to permit a simple mass transfer of the sulfur or nitrogen compound impurities from the hydrocarbonaceous oil phase into the extracting solvent phase. It should be recognized that in this extraction the amine extracting solvent and the formic acid extracting solvent are substantially immiscible with the hydrocarbonaceous oil thus permitting an easy phase separation after the extraction is completed. To the extent of emulsion formation, such is easily broken, e.g., by warming, for phase separation.

The extractions in step (2) of the process of this invention can be generally conducted by simply adding the extracting solvent to the hydrocarbonaceous ore, mixing such with the hydrocarbonaceous oil, allowing phase separation of the mixture to occur and then separating the extracting solvent phase containing therein the sulfur or nitrogen atom impurity content removed from the hydrocarbonaceous oil substrate phase. Conventional chemical engineering techniques can be employed to achieve this extraction conducted in step (2) of the process of this invention. The amine extracting solvent acts to remove sulfur compound impurities and the formic acid extracting solvent acts to remove basic nitrogen compound impurities. Generally a suitable extracting solvent to oil ratio by weight can range from about 0.1:1 to about 4:1, but these ratios are not considered to be limiting. Conventional extraction equipment such as stagewise contactors with countercurrent flow of extracting solvent to hydrocarbonaceous oil can be used.

As indicated above, in step (2) of the process of this invention, an amine extracting solvent and a formic acid extracting solvent are employed in a sequential manner. The order of extraction, whether amine extracting solvent followed by formic acid extracting solvent or formic acid extracting solvent followed by amine extracting solvent, is immaterial and either order can be employed. Preferably, the amine extracting solvent is used in a first extraction followed by use of the formic acid extracting solvent in a second extraction.

It should be recognized to maximize efficiency in these extractions that since the amine extracting solvent is a basic compound and the formic acid extracting solvent is an acid compound, one or more water washing steps between the extractions is desired to minimize the amount of residual extracting solvent remaining from the first extraction. Otherwise, the effectiveness of the extracting solvent used in the second extraction will be reduced since a portion of the extracting solvent used second will be involved in an acid-base reaction with any extracting solvent used first which remains. The use of a water wash, however, is not essential between the extracting steps involving step (2) of the process of this invention or prior to separating the oil from the extracting solvents in step (3). However, one or more water washing steps, for example, up to five water washing steps with the amine extracting solvents and up to three water washing steps with the formic acid extracting solvent, can be advantageously used to minimize and eliminate extracting solvent interaction and efficiency reduction.

The ethylene diamine, monoethanolamine and diethanolamine employed as the amine extracting solvent and the formic acid extracting solvent can be used in their commercially available forms or can be purified to remove any undesired components which might be present in the commercially available forms.

Further, in the extraction step (2), each of the amine extracting solvents and the formic acid extracting solvent can be used in admixture with water to the extent of up to about 50% by weight of water. Water in combination with these extracting solvents can be advantageously used to maximize phase separation and improve yields of oil recovered and to reduce cost since a water mixture with the extracting solvent is less expensive than use of the pure solvent. The amount of water which can be used with any particular extracting solvent can be appropriately determined by running routine screening tests to determine for a particular crude hydrocarbonaceous oil to be purified and under the reaction conditions employed in step (1), which of the amine or formic acid extracting solvents, pure or in admixture with water and to what extent in admixture with water can be advantageously used. These routine screening tests can be simply a consideration of yield and reduction in the nitrogen and sulfur content present, determined by routine chemical analysis, which of the pure extracting solvent or water extracting solvent mixture can be most advantageously used.

Step (3) of the process of this invention simply comprises recovery of the hydrocarbonaceous oil substrate purified as a result of the oxidation step (1) and the extraction step (2) of the process of this invention. Conventional purification procedures for removal of an extracting solvent from a hydrocarbonaceous oil, or for that matter any organic oil in general, can be employed. These extraction procedures include distillation, fractional crystallation and any other appropriate conventional procedures for removing an extracting solvent from an oil substrate. The process of this invention is not limited in any way to selection of a specific hydrocarbonaceous oil recovery and separation procedure.

The process of this invention described above can be advantageously used to purify various types of crude hydrocarbonaceous oils containing heteroatom sulfur and heteroatom nitrogen compound impurities. Generally, crude hydrocarbonaceous oils whose heteroatom sulfur and heteroatom nitrogen content ranges up to about 10% by weight and about 3% by weight, respectively, can be subjected to and purified in accordance with the process of this invention to yield a purified hydrocarbonaceous oil having on the order of at least about 75% and 50% sulfur and nitrogen impurity content removal, respectively. It can be seen from an examination of the essential steps in the process of this invention that because of the mild oxidizing conditions employed in step (1) of the process of this invention, the fact that the essential parameters which need to be controlled can be easily controlled and in view of the efficiency and selectivity of the extracting solvents employed, the amine extracting solvent alone or in admixture with water to remove sulfur compounds and the formic acid extracting solvent, alone or in admixture with water, to remove nitrogen compounds and the easy and conventional chemical engineering processing involved results in quite an economic and advantageous process. This is particularly true when such is compared with the high temperature/high pressure hydrodesulfurization treatments employed conventionally in the past. Further, the advantages of the process of this invention can be seen in comparison with impurity removal processing using catalysts conventionally employed in the art since an expensive catalyst is not needed nor are any steps needed to separate catalyst or regenerate catalyst involved. Thus, the process of this invention is quite advantageous, is considered to be a marked advance over current technology in purification of hydrocarbonaceous oils containing nitrogen/sulfur impurities such as those that might be derived from oil shale, coal and tar sands, and is believed to be of particular commercial significance.

It is to be emphasized that the hydrocarbonaceous oil purified in accordance with the process of this invention can be subjected to subsequent processing as is conventional in the art. For example, the hydrocarbonaceous oil purified in accordance with the process of this invention can be subjected to conventional catalytic cracking, reforming, distillation, and like processing to produce desired products, boiling point fractions, or components therefrom. The hydrocarbonaceous oil produced by the process of this invention should provide an advantageous feedstock material for ultimate use in catalytic cracking, reforming and hydrocracking, as desired, since the amount of sulfur and nitrogen impurity content has been greatly reduced thereby resulting in a feedstock appropriate for use within the scope of the art in such conventional processing.

As indicated above, further embodiments of the process of this invention can arise as a result of utilization of a crude hydrocarbonaceous oil where only one of the heteroatom sulfur or heteroatom nitrogen content is sufficiently high that purification and reduction of that impurity content is desired. For example, should the crude hydrocarbonaceous oil have a high heteroatom sulfur content but relatively low heteroatom nitrogen content, then it would be considered unnecessary to conduct the process of this invention and subject the hydrocarbonaceous oil produced in step (1) to both of the extracting solvents (i) and (ii) as described above for step (2) of this invention. For example, with such a high sulfur content hydrocarbonaceous oil, after conducting step (1) of the process of this invention, the hydrocarbonaceous oil obtained from step (1) would need to be subjected only to extracting with the amine extracting solvent or water mixture thereof to remove the sulfur impurities present. Conversely, should the crude hydrocarbonaceous oil contain a relatively low heteroatom sulfur content but relatively high heteroatom nitrogen content and reduction in the heteroatom nitrogen content was only desired, subjecting the hydrocarbonaceous oil obtained in step (1) for such a crude hydrocarbonaceous oil to the extraction contacting step (2) with formic acid as an extracting solvent to remove the nitrogen impurities would only be necessary.

In general, because of the nature of crude hydrocarbonaceous oils obtained from sources such as oil shale, coal and tar sands, the process of this invention will generally involve conducting step (1) above followed by both extractions in step (2) above and then separation and recovery of the purified oil in step (3). However, where only one of the heteroatom sulfur or heteroatom nitrogen content needs to be reduced, the process of this invention can be appropriately conducted as discussed above.

Further, each of the embodiments of the process of this invention described above can be advantageously conducted in a batch-wise, semi-continuous or continuous manner.

The following examples are given to illustrate the process of the present invention in greater detail. These examples are given for the purpose of exemplification and are not to be construed in any way as limiting the process of the present invention. Unless otherwise indicated herein, all parts, percents, ratios and the like are by weight.

In the examples to follow, the reacting of the hydrocarbonaceous oil with an oxidizing gas containing at least one nitrogen oxide with more than one oxygen atom for each nitrogen atom was conducted using a cylindrical, thermally jacketed Pyrex (trademark of the Corning Glass Works) vessel capable of accommodating a one-liter charge. The reactor was fitted with an impeller shaft terminating with a Teflon (trademark of E. I. du Pont de Nemours & Co., Inc.) impeller. The reactor was further equipped with a thermometer, a sample withdrawal tube and a glass condensor. A gas inlet tube passing through the jacket and into the bottom of the reactor was employed to introduce the oxidizing gas into the system.

In the examples to follow, the shale oil used was Colorado shale oil, Run No. 55 from Laramie Energy Technology Center, with the chemical analyses of the raw shale from which it was derived and the crude shale oil obtained being shown in Tables 1 and 2 given hereinbefore.

The procedure employed for reacting of the oxidizing gas with the shale oil was a weighed amount of the oil, approximately 200 grams, was charged into the reactor. From the weight of the oil charged and the chemical analysis thereof, the total moles of sulfur heteroatom compounds and nitrogen heteroatom compounds were known.

The nitrogen dioxide flow rate into the reactor was determined by considering the nitrogen dioxide mole ratio to the total sulfur and nitrogen heteroatom content and the contact time. The mole ratio set forth in the examples to follow is the ratio of total moles of nitrogen dioxide used for a particular contact time to the total moles of sulfur and nitrogen in the oil charge. Control of the flow rate thereby was achieved using a rotameter, appropriately calibrated. Various contact times for reaction of 5, 15, 30 and 60 minutes, various mole ratios of nitrogen dioxide to total sulfur and nitrogen heteroatom content of 0.1, 0.2, 0.5, 1.0, 1.5, 2.0, 3.0, 4.0 and 5.0 were employed at an initial reactor temperature of 60° C. unless otherwise indicated.

In operation, after calculation of an appropriate rotameter setting, crude hydrocarbonaceous oil was charged to the reactor, the reactor heated to 60° C., the rotameter valve was opened to achieve an appropriate nitrogen dioxide flow into the reactor along with timer starting. Temperature measurements were made at appropriate intervals and at the conclusion, flow of the nitrogen dioxide gas was stopped and a sample of the oxidized hydrocarbonaceous oil was obtained for sulfur and nitrogen analysis. The remainder of the oxidized oil was then employed in extraction.

In the extraction set forth in the examples below, approximately 10 ml of oil was poured into a 60 ml separatory funnel. The solvent to be employed was then added to the oil in the separatory funnel in an appropriate ratio by weight to the oil. The separatory funnel was then shaken and allowed to stand for at least one hour at room temperature to enhance complete separation. After the system has stabilized, an extract phase (solvent+sulfur and nitrogen compounds) was collected and the yield of raffinate (oil+minor amount of dissolved solvent) was determined. The raffinate phase was then washed with water three times to remove the dissolved solvent in the oil. The ratio of water to raffinate used was 5:1 by weight for each washing. After the washing, the final oil obtained and from which the solvent had been removed was collected and weighed.

Sulfur and nitrogen analysis was conducted using a Dohrmann Envirotech MCTS-300 (Microcoulometric Titrating System) employing operating procedures recommended by the manufacturer.

COMPARATIVE EXAMPLE 1

Samples of shale oil were individually contacted with each solvent shown in Table 3 below. Each 10 ml oil sample was contacted for five minutes by shaking with 20 ml of each solvent. After phase separation had occurred, the yield of raffinate with low sulfur content which was obtained was determined and the percent nitrogen and sulfur removal in the raffinate was determined.

TABLE 3

Extraction of Crude Shale Oil

| Extracting Solvent | Oil Yield (%) | Nitrogen Removal (%) | Sulfur Removal (%) |
|---|---|---|---|
| Ethylene Glycol | 97 | 14 | 0 |
| Methanol | 74 | 42 | 2 |
| Acetic Anhydride | 73 | 44 | 10 |
| Formic Acid | 72 | 75 | 5 |
| Furfural | 61 | 59 | 41 |
| Acetic Acid | 54 | 78 | 16 |
| Ethylene Chlorohydrin | 52 | 67 | 34 |
| Dimethyl Formamide | 46 | 69 | 54 |
| Methyl Cyanide | 44 | 48 | 0 |
| Nitromethane | 43 | 37 | 0 |
| Phenol | 38 | 79 | 63 |
| M-Pyrol | 20 | 59 | 50 |
| 80% TEA* | 77 | 15 | 23 |
| Monoethanolamine (MEA) | 76 | 47 | 51 |
| Ethylene diamine | 47 | 40 | 67 |
| 100% Diethanolamine (DEA) | 89 | 33 | 13 |
| 90% DEA | 88 | 14 | 0 |
| 80% DEA | 100 | 9 | 2 |
| 100% MEA | 89 | 21 | 52 |
| 90% MEA | 102 | 18 | 37 |
| 80% MEA | 100 | 13 | 34 |
| 90% Formic Acid | 82 | 63 | 13 |
| Formic Acid/MEA | 60 | 73 | 50 |
| 90% Formic Acid/MEA | 55 | 62 | 48 |
| MEA/MEA | 73 | 42 | 52 |
| Formic Acid (with 10 wt. % $FeCl_3$) | 50 | 84 | 76 |

*No phase separation occurred with 100% & 80% TEA.

The results shown in Table 3 above demonstrate that a high yield of oil (greater than about 75%) could not be achieved simultaneously with a high degree (greater than about 50%) of nitrogen or sulfur heteroatom removal employing a wide range of solvents which have been conventionally used in the prior art for extraction and impurity removal.

COMPARATIVE EXAMPLE 2

A one-liter sample of shale oil was oxidized at 30° C., 1 atmosphere pressure, using a stream of 20% by weight nitrogen dioxide in air, for a contact time of 60 minutes.

A 10 ml sample of this oxidized oil was extracted using 20 ml of methanol using the same procedures as described above in Comparative Example 1. Phase separation did not occur for the resulting mixture of methanol and oxidized shale oil. Thus, methanol was found to be totally unsatisfactory as a means for reducing the sulfur and nitrogen heteroatom content of the oxidized oil.

Water was then added in appropriate ratios to the methanol to achieve phase separation of the mixture with a water/methanol mixture being thereby employed as an extracting solvent. It was found that a reduction (less than 20%) of sulfur and nitrogen heteroatom content in the oxidized oil was achieved, which level of reduction was unsatisfactory.

EXAMPLE 1

Samples of shale oil were oxidized in accordance with the procedures described in Comparative Example 2 above with the mole ratio of nitrogen dioxide to the total moles of sulfur plus nitrogen heteroatom content in the oil of about 1:1.

Following the oxidation, samples of the oxidized oil were extracted using the solvents set forth in Table 4 below, using the extraction procedures as described above in Comparative Example 1. The extraction results obtained are also shown in Table 4 below.

TABLE 4

EXTRACTION IMPROVEMENT DUE TO OXIDATION

| Extracting Solvent | Crude Shale Oil Oil Yield (%) | Crude Shale Oil Sulfur Removal (%) | Oxidized Shale Oil Oil Yield (%) | Oxidized Shale Oil Sulfur Removal (%) |
|---|---|---|---|---|
| Ethylene Glycol | 97 | 0 | 95 | 7 |
| Nitromethane | 43 | 0 | 85 | 23 |
| Acetic Anhydride | 73 | 10 | 76 | 17 |
| Ethylene Chlorohydrin | 52 | 34 | 76 | 36 |
| Methyl Cyanide | 44 | 0 | 75 | 7 |
| Methanol | 74 | 2 | 71 | 0 |
| Furfural | 61 | 41 | 66 | 39 |
| 1-Methyl-2-Pyrrolidinone | 20 | 50 | 51 | 67 |
| Ethylene Diamine | 47 | 67 | 76 | 63 |
| Formic Acid | 72 | 5 | 95 | 3 |

It can be seen that an improvement in oil yield after oxidation of the shale oil, in comparison to direct extraction on the unoxidized shale oil, is achieved for formic acid, nitromethane, ethylene chlorohydrin, ethylene diamine, methyl cyanide and 1-methyl-2-pyrrolidinone. It is further clear that the use of methanol as an extracting solvent is unsatisfactory.

From the results presented in Table 4 above, it can be further seen that only ethylene diamine provides satisfactorily high raffinate yields combined with high levels of sulfur removal. Further, although formic acid is not a solvent which results in a reduction in the sulfur content, virtually all the basic nitrogen compounds are removed using formic acid as an extracting solvent. These results indicate that the extremely high raffinate yield achieved with formic acid makes formic acid a suitable extracting solvent where sequential extractions with solvents exhibiting high sulfur removal capabilities are employed.

EXAMPLE 2

Oxidation of samples of shale oil, as described in Comparative Example 1, was carried out but under varying oxidation conditions as shown in Table 5 below. After the oxidation, 10 ml aliquots of the oxidized shale oil were extracted sequentially, first with formic acid and then with monoethanolamine, using the extracting procedures described in Comparative Example 1. The results obtained are shown in Table 5 below.

TABLE 5

EFFECT OF OXIDATION CONDITIONS ON HETEROATOM REMOVAL USING SEQUENTIAL EXTRACTIONS

| Contact Time (min) | Mole Ratio (NO2/(N + S) | Oil Yield (%) | Sulfur Content/Nitrogen Content: Oxidized Unextracted Oil (%) | Sulfur Content/Nitrogen Content: Oxidized Extracted Oil (%) |
|---|---|---|---|---|
| Crude Oil | 0 | 60.0 | 2.85/1.75 | 1.43/0.47 |
| 5 | 0.1:1 | 61.3 | 2.81/1.85 | 1.42/0.57 |
| | 0.5:1 | 68.0 | 2.22/1.79 | 1.14/0.55 |
| | 1.0:1 | 69.2 | 2.08/1.87 | 1.01/0.77 |
| | 2.0:1 | 73.0 | 1.90/2.65 | 0.78/1.55 |
| | 3.0:1 | 63.9 | 1.81/3.02 | 0.74/1.93 |
| | 4.0:1 | 65.3 | 1.67/3.93 | 0.77/2.13 |
| 15 | 0.5:1 | 64.4 | 2.25/1.78 | 1.07/0.55 |
| | 2.0:1 | 65.7 | 1.85/3.16 | 0.63/1.80 |
| | 4.0:1 | 63.1 | 1.60/4.03 | 0.59/1.89 |
| 30 | 0.5:1 | 62.8 | 2.34/1.84 | 0.73/0.70 |
| | 2.0:1 | 64.1 | 1.88/3.01 | 0.49/2.50 |

TABLE 5-continued

EFFECT OF OXIDATION CONDITIONS ON HETEROATOM REMOVAL USING SEQUENTIAL EXTRACTIONS

| Contact Time (min) | Mole Ratio (NO2/(N + S) | Oil Yield (%) | Sulfur Content/Nitrogen Content: Oxidized Unextracted Oil (%) | Sulfur Content/Nitrogen Content: Oxidized Extracted Oil (%) |
|---|---|---|---|---|
| | 4.0:1 | 66.4 | 1.51/4.15 | 0.49/2.52 |
| 60 | 0.5:1 | 64.2 | 2.30/1.72 | 0.95/0.89 |
| | 2.0:1 | 59.9 | 1.40/3.13 | 0.56/2.87 |

It is apparent from the results shown in Table 5 above that as long as the molar ratio of $NO_2$ to the combined nitrogen plus sulfur heteroatom level is about 1.5:1 or less, good yields of raffinate can be achieved, along with substantial removal of both sulfur and nitrogen compound impurities. Further, it can be further seen that although reductions in sulfur level can be achieved with greater oxidation of the shale oil, undesirably, an increase in the nitrogen content of oil occurs. As a result, these results in combination with the results set forth in FIG. 2 demonstrate it is desirable that about 60% or less by weight of the sulfur impurity content to be oxidized to gaseous sulfur oxides in the oxidation step.

From these results set forth in Table 5, by employing oxidizing conditions and solvent extraction conditions in accordance with the present invention, this results in the ability to remove undesirable nitrogen compounds and sulfur compounds while obtaining a high oil yield.

EXAMPLE 3

A one-liter sample of shale oil was oxidized for 60 minutes at a molar ratio of $NO_2/(N+S)$ of 1.48:1 at a temperature of 30° C., in accordance with the process of the present invention. The oxidized oil obtained was then extracted with mixtures of ethylene diamine and water, in the proportions set forth in Table 6, utilizing the extraction procedures described above for Comparative Example 1. The results obtained are set forth in Table 6 below.

TABLE 6

SULFUR REMOVAL BY OXIDATION/EXTRACTION USING A MIXTURE OF ETHYLENE DIAMINE AND WATER

| Solvent Composition Ethylene Diamine (1) (%) | Raffinate Yield (2) (%) | Content of Sulfur in Raffinate (3) (%) | Sulfur Removal (%) |
|---|---|---|---|
| 30 | 99 | 1.08 | 62 |
| 60 | 100 | 0.92 | 68 |
| 90 | 86 | 0.80 | 72 |
| 100 | 77 | 0.62 | 78 |
| 100 (shale oil (4)) | 47. | — | 67 |

Notes:
(1) Balance of solvent = water.
(2) Yield = Weight of raffinate/Weight of oil subject to oxidation.
(3) Oxidized oil = 1.65% sulfur prior to extraction.
(4) Prior to oxidation.

REFERENCE EXAMPLE 1

A sample of crude shale oil was extracted in accordance with the procedures of Comparative Example 1 utilizing ethylene diamine as the extracting solvent with variations, as shown in Table 7 below in the ratio of extracting solvent to oil. The results obtained in terms of sulfur removal in comparison with the weight ratio of solvent to oil are shown in Table 7 below.

TABLE 7

SULFUR REMOVAL BY ETHYLENE DIAMINE WITH DIFFERENT SOLVENT TO OIL RATIO

| Weight Ratio of Solvent to Oil | Raffinate Yield (%) | Sulfur Content in Raffinate (%) | Sulfur Removal (%) |
|---|---|---|---|
| 1:1 | 76.7 | 0.620 | 62.4 |
| 2:1 | 72:9 | 0.619 | 62.5 |
| 3:1 | 72.1 | 0.571 | 65.4 |
| 4:1 | 70.5 | 0.543 | 67.1 |

Note:
Weight % of sulfur unoxidized after oxidation but before extraction = 1.65.
Raffinate = mixture of oxidized oil and dissolved solvent.
Yield = weight of raffinate/weight of original oil.

The results set forth in Table 7 above demonstrate that removal of sulfur impurity content can be increased as the extracting solvent to oil ratio is increased but that the yield decreases somewhat. However, the overall results indicate that a weight ratio of extracting solvent to oil within the range of about 1:1 to about 4:1 can be employed without markedly deleterious effects on yield.

Similar results to the above with ethylene diamine were also obtained with monoethanolamine using the same procedures as described above with various extracting solvent to oil ratios as shown in Table 8 below.

TABLE 8

SULFUR CONTENT OF OIL IN THE RAFFINATE AND IN EXTRACT USING MONOETHANOLAMINE AS EXTRACTING SOLVENT

| Weight Ratio of Solvent to Oil | Sulfur Content of Oil | |
|---|---|---|
| | Raffinate (wt. %) | Extract (wt. %) |
| 0.5:1 | 1.37 | 19.19 |
| 1.0:1 | 1.36 | 18.46 |
| 2.0:1 | 1.34 | 17.20 |
| 3.0:1 | 1.27 | 17.05 |
| 4.0:1 | 1.25 | 15.35 |

REFERENCE EXAMPLE 2

Samples of shale oil were extracted in accordance with the procedures set forth in Comparative Example 1 using monoethanolamine as an extraction solvent and by varying the ratio of extracting solvent to oil. The results obtained and effect on nitrogen content in the oil in the raffinate and in the extract are shown in Table 9 below.

TABLE 9

NITROGEN CONTENT OF OIL IN RAFFINATE AND IN EXTRACT USING MONOETHANOLAMINE AS EXTRACTING SOLVENT

| Weight Ratio of Solvent to Oil | Nitrogen Content of Oil | |
|---|---|---|
| | Raffinate (wt. %) | Extract (wt. %) |
| 0.5:1 | 1.19 | 9.79 |
| 1.0:1 | 1.11 | 9.40 |
| 2.0:1 | 1.03 | 9.22 |
| 3.0:1 | 0.99 | 8.91 |
| 4.0:1 | 1.00 | 8.35 |

REFERENCE EXAMPLE 3

Shale oil was extracted in accordance with the procedures described in Comparative Example 1 using formic acid as an extracting solvent to remove nitrogen compounds as impurities. The ratio of formic acid as an extracting solvent to oil was varied and the results obtained are shown in Table 10 below.

TABLE 10

NITROGEN CONTENT OF OIL IN RAFFINATE AND IN EXTRACT USING FORMIC ACID AS EXTRACTING SOLVENT

| Weight Ratio of Solvent to Oil | Nitrogen Content of Oil | |
|---|---|---|
| | Raffinate (wt. %) | Extract (wt. %) |
| 1.0:1 | 0.394 | 4.18 |
| 2.0:1 | 0.377 | 3.57 |
| 4.0:1 | 0.352 | 3.60 |
| 6.0:1 | 0.339 | 3.40 |
| 9.0:1 | 0.343 | 3.66 |
| 15.0:1 | 0.346 | 3.30 |

The above results set forth in Table 10 demonstrate that lower weight ratios of solvent to oil are desirable but a markedly deleterious effect on nitrogen content removal does not result. Desirably, weight ratios of solvent to oil of about 4:1 or less provide efficient nitrogen content removal with the preferred range being about 0.5:1 to 1:1 for good removal of sulfur and nitrogen.

While the invention has been described in detail and with respect to specific embodiments thereof, it will be apparent to one skilled in the art that modifications and changes can be made therein without departing from the spirit and scope thereof.

What is claimed is:

1. A process for purifying hydrocarbonaceous oils containing heteroatom sulfur and heteroatom nitrogen compound impurities comprising the steps of:

(1) reacting said hydrocarbonaceous oil with an oxidizing gas containing at least one nitrogen oxide with more than one oxygen atom for each nitrogen atom while maintaining
  (a) the molar ratio of the nitrogen oxide to the total of the sulfur heteroatom content and the nitrogen heteroatom content to about 1.5:1 or less,
  (b) the reaction time to about one hour or less,
  (c) the temperature to about 100° C. or less, and
  (d) a conversion of sulfur heteroatom content into gaseous sulfur oxides to about 60% or less on a weight basis;

(2) contacting the oil from step (1) above with
  (i) an extracting solvent comprising at least one amine selected from the group consisting of ethylene diamine, monoethanolamine, diethanolamine and mixtures thereof, or a water mixture thereof containing about 50% by weight or less water, and
  (ii) an extracting solvent comprising formic acid or a water mixture thereof containing about 50% by weight or less water,
  with the contacting with (i) and (ii) being sequential and in any order; and (3) separating said oil from step (2) above from said extracting solvents;

to recover purified hydrocarbonaceous oil.

2. The process of claim 1, wherein said molar ratio (a) is about 1:1 or less.

3. The process of claim 1, wherein the reaction time (b) is about 30 minutes or less.

4. The process of claim 1, wherein the temperature (c) is about 60° C. or less.

5. The process of claim 1, wherein said extracting solvent (i) is monoethanolamine.

6. The process of claim 1, wherein said extracting solvent (i) is monoethanolamine undiluted with water.

7. The process of claim 1, wherein said molar ratio (a) is about 0.5:1 or less, the reaction time (b) is about five minutes, the temperature (c) is about 30° C., and said extracting solvent (i) is monoethanolamine.

8. A process for purifying hydrocarbonaceous oil containing heteroatom sulfur and heteroatom nitrogen compound impurities comprising the steps of:

(1) reacting said oil with an oxidizing gas containing at least one nitrogen oxide with more than one oxygen atom for each nitrogen atom while maintaining
  (a) the molar ratio of the nitrogen oxide to the total of the sulfur heteroatom content and the nitrogen heteroatom content to about 1.5:1 or less,
  (b) the reaction time to about one hour or less,
  (c) the temperature to about 100° C. or less, and
  (d) a conversion of sulfur heteroatom content into gaseous sulfur oxides to about 60% or less on a weight basis;

(2) contacting the oil from step (1) above with an extracting solvent comprising ethylene diamine, or a water mixture thereof containing about 50% by weight or less water; and (3) separating said oil from step (2) above from said extracting solvent to recover purified hydrocarbonaceous oil.

9. The process of claim 8, wherein said molar ratio (a) is about 1:1 or less.

10. The process of claim 8, wherein the reaction time (b) is about 30 minutes or less.

11. The process of claim 8, wherein the temperature (c) is about 60° C. or less.

12. The process of claim 8, wherein said molar ratio (a) is about 0.5:1 or less, the reaction time (b) is about five minutes, and the temperature (c) is about 30° C.

13. A process for purifying hydrocarbonaceous oils containing heteroatom sulfur and heteroatom nitrogen compound impurities comprising the steps of:

(1) reacting said oil with an oxidizing gas containing at least one nitrogen oxide with more than one oxygen atom for each nitrogen atom while maintaining
  (a) the molar ratio of the nitrogen oxide to the total of the sulfur heteroatom content and the nitrogen heteroatom content to about 1.5:1 or less,
  (b) the reaction time to about one hour or less,
  (c) the temperature to about 100° C. or less, and
  (d) a conversion of sulfur heteroatom content into gaseous sulfur oxides to about 60% or less on a weight basis;

(2) contacting the oil from step (1) above with an extracting solvent comprising formic acid or a water mixture thereof containing about 50% by weight or less water; and (3) separating said oil from step (2) above from said extracting solvent to recover purified hydrocarbonaceous oil.

14. The process of claim 13, wherein said molar ratio (a) is about 1:1 or less.

15. The process of claim 13, wherein the reaction time (b) is about 30 minutes or less.

16. The process of claim 13, wherein the temperature (c) is about 60° C. or less.

17. The process of claim 13, wherein said molar ratio (a) is about 0.5:1 or less, the reaction time (b) is about five minutes and the temperature (c) is about 30° C.

* * * * *